US009539617B2

(12) United States Patent
Darmon et al.

(10) Patent No.: US 9,539,617 B2
(45) Date of Patent: Jan. 10, 2017

(54) SORTING MACHINE FOR SORTING FLAT ARTICLES HAVING NON-UNIFORM PHYSICAL CHARACTERISTICS, AND A METHOD OF SORTING SAID FLAT ARTICLES

(71) Applicant: SOLYSTIC, Gentilly (FR)

(72) Inventors: Guy Darmon, Marsaz (FR); Xavier Bastien, Toulaud (FR); Pierre Campagnolle, Allex (FR); Jean-Michel Reboul, Saint Donat sur l'Herbasse (FR)

(73) Assignee: SOLYSTIC, Gentilly (FR)

( * ) Notice: Subject to any disclaimer, the term of this patent is extended or adjusted under 35 U.S.C. 154(b) by 0 days.

(21) Appl. No.: 13/805,838

(22) PCT Filed: Oct. 9, 2012

(86) PCT No.: PCT/FR2012/052291

§ 371 (c)(1),
(2) Date: Dec. 20, 2012

(87) PCT Pub. No.: WO2013/093250

PCT Pub. Date: Jun. 27, 2013

(65) Prior Publication Data

US 2014/0231317 A1 Aug. 21, 2014

(30) Foreign Application Priority Data

Dec. 23, 2011 (FR) ..... 11 62391

(51) Int. Cl.
*B07C 5/00* (2006.01)
*B07C 1/04* (2006.01)
(Continued)

(52) U.S. Cl.
CPC . *B07C 5/00* (2013.01); *B07C 1/04* (2013.01); *B65H 29/40* (2013.01); *B65H 29/60* (2013.01);
(Continued)

(58) Field of Classification Search
CPC ..... B65H 2553/41; B65H 29/40; B65H 29/60; B65H 31/06; B65H 2511/10; B65H 2511/40; B65H 2511/414; B65H 2511/22; B65H 2701/1916; B65H 2301/4214; B07C 1/02; B07C 1/10; B07C 1/14; B07C 1/16; B07C 5/34
(Continued)

(56) References Cited

U.S. PATENT DOCUMENTS 6,082,732 A * 7/2000 Hutchison et al. ..... 271/265.04
7,819,400 B2 * 10/2010 Miyoshii et al. ..... 271/265.04
(Continued)

FOREIGN PATENT DOCUMENTS

CN 1678411 A 10/2005
EP 2 165 776 A1 3/2010
(Continued)

OTHER PUBLICATIONS

French Search Report for FR 1162391 dated Aug. 6, 2012.
(Continued)

*Primary Examiner* — Joseph C Rodriguez
*Assistant Examiner* — Kalyanavenkateshware Kumar
(74) *Attorney, Agent, or Firm* — Sughrue Mion, PLLC

(57) ABSTRACT

A sorting machine (1) for sorting flat articles (100, 101) having non-uniform physical characteristics, the sorting machine having sorting outlets equipped with stackers (3) controlled by a monitoring and control unit in compliance with a plurality of programs, each of which is assigned to a predefined type of flat article (100, 101) having predeter-
(Continued)

mined physical characteristics and setting predetermined operating parameters such as, in particular, the pitch between said flat articles (100, 101), and the speed at which said flat articles (100, 101) are conveyed, the sorting machine (1) having means for determining the predetermined physical characteristics of each incoming flat article (101) arriving in said stacker (3), said monitoring and control unit being arranged to act after said determination to assign a predefined type of flat article to said flat article (101) arriving in said stacker (3) and to activate the corresponding unstacking program so as to apply predetermined operating parameters while said incoming flat article (101) is being stacked.

3 Claims, 1 Drawing Sheet

(51) Int. Cl.
*B65H 29/40* (2006.01)
*B65H 31/06* (2006.01)
*B65H 29/60* (2006.01)

(52) U.S. Cl.
CPC ..... *B65H 31/06* (2013.01); *B65H 2301/4214* (2013.01); *B65H 2404/652* (2013.01); *B65H 2406/122* (2013.01); *B65H 2511/10* (2013.01); *B65H 2511/22* (2013.01); *B65H 2511/40* (2013.01); *B65H 2511/414* (2013.01); *B65H 2513/20* (2013.01); *B65H 2513/42* (2013.01); *B65H 2557/23* (2013.01); *B65H 2701/1916* (2013.01)

(58) Field of Classification Search
USPC ..... 209/534, 552, 583; 271/265.04, 305
See application file for complete search history.

(56) References Cited

U.S. PATENT DOCUMENTS

| | | | | |
|---|---|---|---|---|
| 2004/0262836 | A1* | 12/2004 | Tamamoto | 271/264 |
| 2008/0106027 | A1 | 5/2008 | Miyoshii et al. | |
| 2010/0329833 | A1 | 12/2010 | Ambroise et al. | |

FOREIGN PATENT DOCUMENTS

| | | | |
|---|---|---|---|
| FR | 2 925 474 | A1 | 6/2009 |
| JP | 6243964 | U | 3/1987 |
| JP | 8198493 | A | 8/1996 |
| JP | 2001270615 | A | 10/2001 |
| JP | 200518177 | A | 1/2005 |

OTHER PUBLICATIONS

Communication dated Jul. 28, 2015, issued by the Chinese Intellectual Property Office in counterpart Chinese Application No. 201280058974.4.
Communication dated Mar. 1, 2016, issued by the Japan Patent Office in counterpart Japanese Application No. 2014-548133.

* cited by examiner

SORTING MACHINE FOR SORTING FLAT ARTICLES HAVING NON-UNIFORM PHYSICAL CHARACTERISTICS, AND A METHOD OF SORTING SAID FLAT ARTICLES

CROSS REFERENCE TO RELATED APPLICATIONS

This application is a National Stage of International Application No. PCT/FR2012/052291 filed Oct. 9, 2012, claiming priority based on French Patent Application No. 11 62391 filed Dec. 23, 2011, the contents of all of which are incorporated herein by reference in their entirety.

TECHNICAL FIELD

The invention relates generally to a sorting machine for sorting flat articles having non-uniform physical characteristics, the sorting machine having at least one sorting outlet equipped with a stacker suitable for stacking the flat articles on edge in a stacking zone, the stacker being controlled by a monitoring and control unit in compliance with at least one unstacking program that sets predetermined operating parameters for the stacker such as, in particular, the pitch between the flat articles, and the speed at which the flat articles are conveyed.

The invention also relates to a method of sorting flat articles having non-uniform physical characteristics, during which method the flat articles are stacked on edge in a stacking zone in compliance with predetermined operating parameters, such as, in particular, the pitch between the flat articles, and the speed at which the flat articles are conveyed.

In the meaning of the invention, a "flat article" means, particularly but not exclusively, a mailpiece. Mailpieces that are suitable for being sorted and stacked using the sorting machine may be of various sizes, and they may also have a variety of mechanical characteristics, in particular as regards stiffness. Such a mailpiece may, inter alia, be an ordinary letter, a magazine, an envelope with or without a window, a newspaper, or indeed a catalogue wrapped in plastic or in paper, with or without gussets.

PRIOR ART

In conventional manner, a machine for sorting flat articles has a feed inlet with a magazine, and an unstacker for putting the flat articles in series and on edge. The flat articles are then, in general, conveyed towards an acquisition system, and then directed towards sorting outlets that are in side-by-side alignment. Conventionally, each sorting outlet is equipped with a stacker suitable for stacking the flat articles on edge, in a stacking zone. The stacker has a stacking zone of variable dimensions, making it possible to receive the flat articles accumulating in a stack. The stacking zone is defined by a retaining element mounted to move under the effect of the accumulation of flat articles. The stacking zone is also defined by a jogging edge, against which the flat articles come into abutment. A rotary actuator is caused to start moving on arrival of each flat article going towards the stacking zone so as to accompany the stacking of the flat articles.

Conventionally, the flat articles are sorted and stacked by means of sorting machines that are dedicated as a function of the flat article format to be processed. There are thus various predetermined formats, such as the "letters" format for flat articles of small size, and the "flats" format for flat articles of large size. There are also various kinds of flat articles, e.g. sealed mailpieces such as letters, and unsealed mailpieces such as certain magazines. Flat articles can also be made of different materials, such as, for example, paper and plastic. Sorting machines are adjusted so that their operating parameters are adapted optimally to suit predetermined types of flat article (format, kind, and material). Such adjustments of the operating parameters enable sorting machines to achieve very high throughput rates.

However, in order to satisfy processing needs, it is often necessary to be able to process flat articles of different types in the same sorting machine. Thus, sorting machines are no longer dedicated to one predetermined type of flat article, but rather they need to be compatible with various types of flat article. Therefore, sorting machines are adjusted to middle operating parameter settings that are compatible with the various types of flat article. However, although such middle operating parameters can be optimum for one type of flat article, they are not optimum for the others, thereby, overall, giving rise to reductions in the efficiency of the sorting machine compared with when dedicated sorting machines are used.

SUMMARY OF THE INVENTION

An object of the invention is to remedy those drawbacks by proposing a flat article sorting machine and a flat article sorting method that are capable of accommodating a variety of types of flat article, while also guaranteeing optimum sorting efficiencies.

To this end, the invention provides a sorting machine for sorting flat articles having non-uniform physical characteristics, said sorting machine having at least one sorting outlet equipped with a stacker suitable for stacking said flat articles on edge in a stacking zone, said stacker being controlled by a monitoring and control unit in compliance with at least one unstacking program that sets predetermined operating parameters for the stacker such as, in particular, the pitch between the flat articles, and the speed at which the flat articles are conveyed, said sorting machine being characterized in that it has a plurality of programs, each of which is assigned to a predefined type of flat article having predetermined physical characteristics, and in that it has determination means for determining the predetermined physical characteristics of each incoming flat article arriving in the stacker, the monitoring and control unit being arranged to act after the determination to assign a predefined type of flat article to the flat article arriving in the stacker and to activate the corresponding unstacking program so as to apply predetermined operating parameters while the incoming flat article is being stacked.

The basic idea of the invention is to determine the physical characteristics of each flat article before it arrives in the stacker and to use said physical characteristics to parameterize the stacker in optimum manner as a function of the type of flat article to which the flat article arriving in the stacker belongs.

The sorting machine of the invention may advantageously have the following features:

- the determination means include detection means provided upstream from the stacker and suitable for detecting the predetermined characteristics of the flat article arriving in the stacker;
- the stacker has at least one retaining element suitable for receiving the stacked flat articles and a rotary actuator suitable for stacking the flat articles against the retaining element, the rotary actuator being coupled to a brushless motor controlled by said monitoring and control unit in compliance with the active unstacking program for activating at least one of the start instant and speed profile accordingly;

the stacker has at least one trailing edge flap provided upstream from the stacking zone, the trailing edge flap being mounted to move between a retracted position in which it is set back from the stacking zone so as not to interfere with the flat articles arriving in the stacking zone and an active position in which it is pivoted towards the stacking zone so as to press the trailing portion of the flat article being stacked towards the stacking zone, the trailing edge flap being controlled by the monitoring and control unit so as to go from its retracted position to its active position as a function of the active unstacking program.

the stacker has at least one blower nozzle provided upstream from the stacking zone and suitable for blowing a jet of air cutting across the path of the flat articles arriving in the stacking zone so as to urge any open piece of the flat article to re-close towards the flat article, the blower nozzle being controlled by the monitoring and control unit to blow the jet of air as a function of the active unstacking program.

The invention also provides a method of sorting flat articles having non-uniform physical characteristics, during which method the flat articles are stacked on edge in a stacking zone, by means of a stacker, in compliance with predetermined operating parameters, such as, in particular, the pitch between the flat articles, and the speed at which the flat articles are conveyed, said method being characterized in that predefined types of flat article having predetermined physical characteristics are predetermined, in that, upstream from the stacker, the physical characteristics of each incoming flat article arriving in the stacker are determined, in that a predefined type of flat article is assigned to the incoming flat article, and in that, as a function of the assigned predefined type, predetermined operating parameters are applied while the incoming flat article is being stacked.

The method of the invention may advantageously have the following features:

in order to determine the predefined type, the predetermined physical characteristics of the flat article arriving in the stacker are detected upstream from the stacker;

in order to perform the stacking, a rotary actuator is used that is actuated by means of a brushless motor, at least the start instant and the speed profile of the motor being controlled as a function of the predefined type of flat of article that is determined;

in order to perform the stacking, at least one trailing edge flap is used that is disposed upstream from the stacking zone and that is moved between a retracted position in which it is set back from the stacking zone so as not to interfere with the flat articles arriving in the stacking zone and an active position in which it is pivoted towards the stacking zone so as to press the trailing portion of the flat article being stacked towards the stacking zone, and the trailing edge flap is controlled to go from its retracted position to its active position as a function of the predefined type of flat article that is detected;

in order to perform the stacking, at least one blower nozzle is used that is provided upstream from the stacking zone for the purpose of blowing a jet of air cutting across the path of the flat articles arriving in the stacking zone so as to urge any open piece of the flat article to re-close towards the flat article, and the blower nozzle is controlled as a function of the type of flat article that is detected.

BRIEF DESCRIPTION OF THE DRAWING

The present invention can be better understood and other advantages appear on reading the following detailed description of an embodiment given by way of non-limiting example and with reference to the accompanying drawing, in which.

DESCRIPTION OF THE IMPLEMENTATIONS

Figure 1:
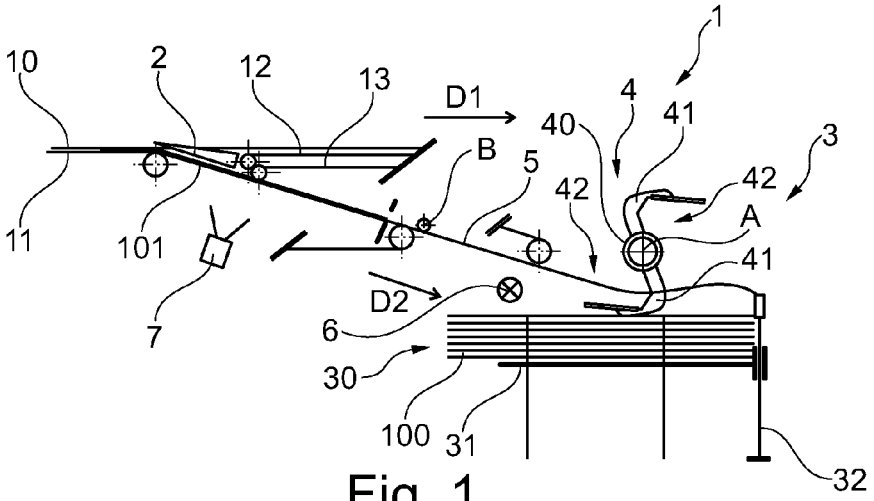
FIGS. 1 to 3 are diagrammatic section views of a portion of a sorting machine of the invention shown in three different operating configurations.
Figure 2:
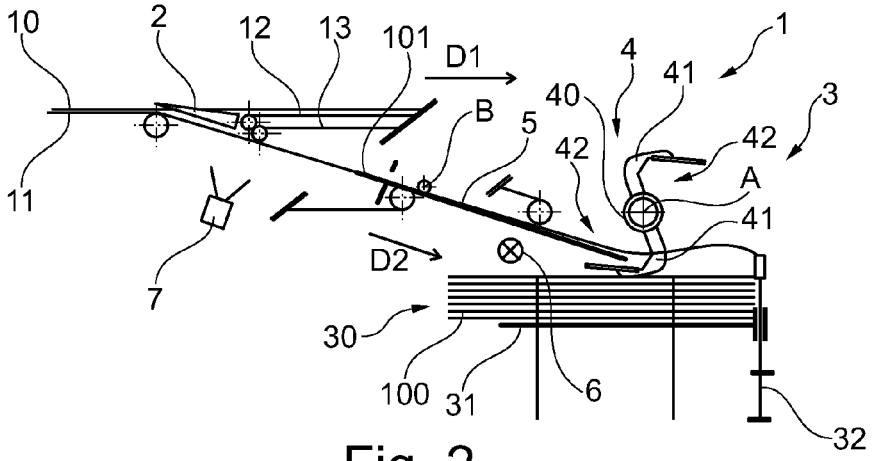
Figure 3:
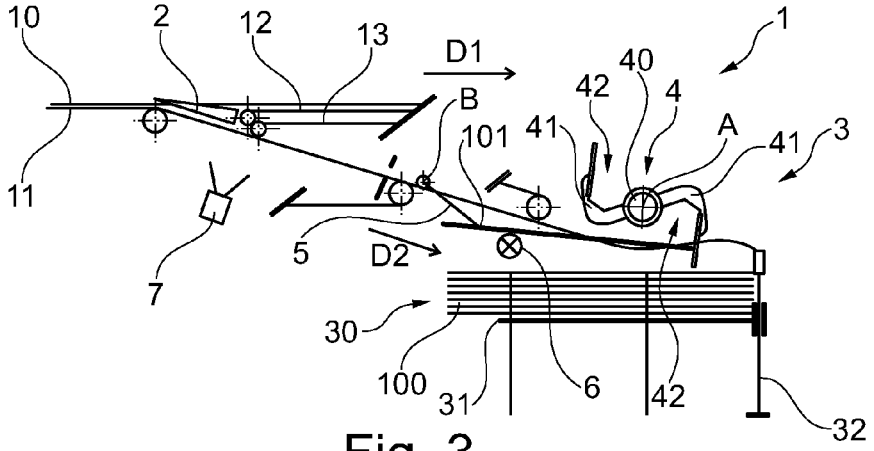

With reference to FIGS. 1 to 3, the sorting machine 1 for sorting flat articles 100, 101 includes a plurality of conveyor belts 10, 11, 12, 13 defining a main conveying direction indicated by arrow D1, and a plurality of secondary conveying directions, only one of which is shown and indicated by arrow D2. The sorting machine 1 is thus suitable for conveying the flat articles 100, 101 on edge, by nipping them between said conveyor belts 10, 11, 12, 13. Each secondary conveying direction D2 is separated from the main conveying direction D1, at a branch-off, by a switch flap 2 suitable for pivoting automatically to guide the flat articles 100, 101 either towards the main conveying direction D1 or towards the secondary conveying direction D2, as a function of a predetermined sorting plan. Each secondary conveying direction D2 opens out at a sorting outlet equipped with a stacker 3.

The stacker 3 has a stacking zone 30 defined by a retaining element 31 mounted to move in translation along a rod 32. The retaining element 31 can thus be moved between a start-of-stack position and an end-of-stack position. During this movement, the position of the retaining element 31 is adapted continuously to fit the height of the stack of flat articles 100 being constituted in the stacking zone 30. This retaining element 31 is also coupled to return means (not shown) urging it to return to its start-of-stack position.

The stacker 3 also has a rotary actuator 4 of the bucket wheel type that is mounted to rotate about an axis A that is substantially perpendicular to the main conveyor direction D1 and to the secondary conveyor direction D2. The rotary actuator 4 is placed in the path of the incoming flat articles 101 arriving in the stacking zone 30 in the secondary direction D2. This rotary actuator 4 has a hub carried by a pin embodying the axis A and from which two spurs 41 extend that are curved in directions opposite to the direction in which the flat articles 101 arrive in the secondary conveying direction D2. The spurs 41 define slots 42 suitable for finding themselves, in succession, in the path of the flat articles 101 arriving in the stacking zone 30 in the secondary direction D2, as the rotary actuator 4 rotates. When a flat article 101 arrives facing a spur 41, its leading edge is received in the slot 42 and is accompanied as it is being stacked. The rotary actuator 4 is coupled to a motor of the type that is brushless or that has a permanent magnet on its rotor with a rotor position sensor (not shown), it being possible to control the start time and the speed profile of the motor by means of a monitoring and control unit (not shown). For example, this motor of the brushless type has torque of at least about 7 newton meters (Nm). The motor of the brushless type is thus suitable for starting, accelerating, slowing down, and stopping the rotary actuator 4 so as to adapt to accommodate the incoming types of flat articles 101 to be stacked. The motor of the brushless type makes it possible to achieve these operations with rapid and frequent changes in acceleration and/or in speed setpoint, without overheating, with excellent repetitiveness, and with the setpoints being complied with accurately. The motor of the brushless type thus allows operating cycles to take place that are different as a function, in particular, of the weight and of the size of the flat articles 100, 101, while also applying appropriate resistive and/or drive torque. By way of example, flat articles 100, 101 of standard dimensions can thus be stacked at a standard speed of 4 meters per second (m/s), i.e. 80%, or at a speed less than 3.5 m/s for flat articles 100, 101 of larger size.

The sorting machine 1 also has a trailing edge flap 5 provided upstream from the stacking zone 30, between the switch flap 2 and the rotary actuator 4. The trailing edge flap 5 is provided on the same side of the path of the flat articles 100, 101 as the rotary actuator 4, and is mounted to pivot about an axis B relative to which it is moveable between a retracted position (shown in FIGS. 1 and 2) and an active position (shown in FIG. 3). In its retracted position, the trailing edge flap 5 is set back from the path of the flat articles 101 arriving in the secondary direction D2 and in particular is set back from the stacking zone 30. Thus, it does not interfere with the flat articles 101 arriving in the stacking zone 30. In its active position, the trailing edge flap 5 is pivoted towards the stacking zone 30, and it cuts across the path of the flat articles 101 arriving in the secondary direction D2. The trailing edge flap 5 is controlled by the monitoring and control unit so that it goes from its retracted position to its active position when the trailing edge of the flat article 101 arriving in the stacking zone 30 goes past the trailing edge flap 5. Thus, the trailing edge flap 5 presses the flat article 101 arriving in the stacking zone 30 against the stack of flat articles 100 already formed in said stacking zone 30. The role of the trailing edge flap 5 is to disengage the trailing edge of each flat article 101 from the conveyor belt 13 whenever said flat article 101 is tending to remain aligned with the secondary path D2 and is tending to bear improperly against the stack being formed.

The sorting machine 1 also has a blower nozzle 6 provided upstream from the stacking zone 30, between the trailing edge flap 5 and the rotary actuator 4. The blower nozzle 6 is disposed on the other side of the path of the flat articles 100, 101 from the side on which the trailing edge flap 5 and the rotary actuator 4 are disposed. The blower nozzle 6 is suitable for blowing a jet of air cutting across the path of the flat articles 101 arriving in the stacking zone 30. This jet of air tends to re-close any open piece of the flat article 101 arriving in the stacking zone 30 against the face of said flat article. It is frequent to encounter a fold-back defect for certain unsealed flat articles 101, e.g. of the magazine type, in which the cover page facing the stacking zone 30 can tend to fold back on being stacked. The jet of air makes it possible to keep the cover closed or to re-close it if it is tending to open. The blower nozzle 6 is controlled by the monitoring and control unit to be in the closed state (as shown in FIGS. 1 and 3) so as not to blow any jet of air, or to be in the open state (as shown in FIG. 2) so as to blow a jet of air. This jet of air of preferably directed downstream and towards the stacking zone 30.

In the embodiment of the invention that is shown, the sorting machine 1 finally has detection means 7, e.g. a camera, scales, a laser, or any other suitable equipment, making it possible to detect predetermined physical characteristics of the flat articles 101 before they arrive in the stacker 3, e.g. length, height, thickness, weight, stiffness, material, or kind of the flat articles 101. These detection means 7 represented diagrammatically by a camera, are provided upstream from the stacker 3 and in particular upstream from the trailing edge flap 5, from the blower nozzle 6, and from the rotary actuator 4.

In another embodiment of the invention (not shown), the predetermined physical characteristics of the flat articles 101 arriving in the stacker 3 are obtained via storage means for storing information acquired during preceding sorting passes. In which case, the sorting machine 1 has prior knowledge of the sequence of flat articles 101, and in particular of the sequence of the predetermined characteristics of said flat articles 101. To this end, these predetermined characteristics may have been detected during a prior sorting step and stored in any type of media such as, for example, a file, or a Radiofrequency Identification (RFID) card. Thus, the determination means may consist of means for reading predetermined characteristics that are pre-recorded for a given sequence of flat articles to be stacked.

The monitoring and control unit uses these predetermined physical characteristics for controlling the operating parameters of the stacker 3 and more specifically the operating parameters of the trailing edge flap 5, of the blower nozzle 6, and of the rotary actuator 4. To this end, the sorting machine 1 has a plurality of programs, each of which serves for a predetermined type of flat article. The number of predefined types of flat article depends on the fineness of adjustment that is sought. Each predefined type of flat article is associated with predetermined operating parameters that are optimized for the predefined type in question. It is thus possible to predefine combinations between predefined types and predefined operating parameters as in the non-limiting examples listed below.

Predefined type 1+operating parameters 1:
- length: Less than 210 millimeters (mm); and
- height: less than 150 mm;
  - speed profile Pv1 for the rotary actuator 4 (about 4 m/s);
  - rotary actuator 4 started at start instant Td1;
  - trailing edge flap 5 not used (in the retracted position); and
  - blower nozzle 6 not used (in the closed state).

Predefined type 2+operating parameters 2:
- length: less than 210 mm; and
- height: greater than 150 mm;
  - speed profile Pv2 for the rotary actuator 4 (about 3.5 m/s);
  - rotary actuator 4 started at start instant Td2;
  - trailing edge flap 5 not used (in the retracted position); and
  - blower nozzle 6 not used (in the closed state).

Predefined type 3+operating parameters 3:
- length: greater than 210 mm; and
- material: plastic;
  - speed profile Pv3 for the rotary actuator 4;
  - rotary actuator 4 started at start instant Td2;
  - trailing edge flap 5 used (in the retracted position and in the active position); and
  - blower nozzle 6 not used (in the closed state).

Predefined type 4+operating parameters 4:
- length: greater than 210 mm; and
- unsealed flat article;
  - speed profile PV4 for the rotary actuator 4 (about 3.5 m/s);
  - rotary actuator 4 started at start instant Td2;

trailing edge flap 5 used (going from the retracted position to the active position at the pivot instant Tp1); and blower nozzle 6 used (going from the closed state to the open state at the blow instant Ts1).

Predefined type 5+operating parameters 5:

length: greater than 210 mm;

material: plastic;

speed profile Pv5 for the rotary actuator 4 (about 3.5 m/s);

rotary actuator 4 started at start instant Td3;

trailing edge flap 5 used (going from the retracted position to the active position at the pivot instant Tp2); and blower nozzle 6 not used (in the closed state).

Naturally, the operating parameters of the stacker 3 may be combined differently in order to obtain a large number of other possible combinations of operating parameters.

The method of sorting flat articles 100, 101, implemented by means of a sorting machine 1 as described above, is explained below.

With reference to FIG. 1, certain flat articles 100 have already been stacked in the stacking zone 30, gradually moving the retaining element 31 away from the rotary actuator 4. The next flat article 101 to be stacked is conveyed by the conveyor belts 10, 11, 12 and is guided in the secondary direction D2 by means of the switch flap 2. The rotary actuator 4 is in a position to receive the flat article 101 in its slot 42 and to guide it while it is being stacked. The blower nozzle 6 is in the closed state and the trailing edge flap 5 is in its retracted position. At this stage, the physical characteristics of the flat article 101 are detected by the detection means before said flat article arrives in the stacker 3. For example, by means of a first correspondence table, the predetermined type of flat article corresponding to the physical characteristics detected for the incoming flat article 101 are determined, and a predefined type is assigned accordingly to the flat article 101. Thus, before the flat article 101 arrives in the stacker 3, and on the basis of the predefined type, it is possible to control operation of the trailing edge flap 5, of the blower nozzle 6, and of the rotary actuator 4 during the stacking.

Then, with reference to FIG. 2, the flat article 101 has advanced towards the stacking zone 30 and is situated beyond the detection means 7. It is at the leading edge flap 5 which is still in its retracted position, and it is engaged in the slot 42 of the rotary actuator 4. At this stage, the rotary actuator 4 is controlled so as to start at an appropriate start instant Td1-3 and in compliance with an appropriate speed profile PV1-5. In addition, the blower nozzle 6 is controlled by the monitoring and control unit to go, at the blow instant Ts1, from its closed state to its open state so as to reclose any partly open piece of the flat article 101. The detection means 7 are then suitable for detecting the physical characteristics of the next flat article 101 before it arrives in the stacker 3.

Then, with reference to FIG. 3, the flat article 101 is accompanied by the rotary actuator 4 as it is being stacked. At this stage, the blow nozzle 6 is controlled by the monitoring and control unit to be in the closed state, the detection means 7 are capable of detecting the physical characteristics of the next flat article 101, and the rotary actuator 4 continues to be controlled in compliance with the appropriate speed profile PV1-5. The trailing edge flap 5 is controlled by the monitoring and control unit to go, at a predetermined instant Tp1-2, from its retracted position to its active position so as to press the trailing edge of the flat article 101 arriving in the stacking zone against the stack of flat articles 100 that is already formed.

The sorting machine 1 and the sorting method of the invention thus make it possible to stack any type of flat article 100, 101 reliably and effectively while taking account of their differences in physical characteristics so as to apply optimum specific operating parameters making it possible to guarantee good sorting efficiency when sorting the flat articles 100, 101.

The invention claimed is:

1. A sorting machine for sorting different types of flat articles having non-uniform physical characteristics, said sorting machine comprising a conveyor for conveying said flat articles according to a certain speed and one by one according to a certain pitch, said sorting machine comprising a switch flap suitable for pivoting automatically to guide the flat articles either towards a main conveying direction or towards a secondary conveying direction as a function of a predetermined plan, each secondary conveying direction opens out a sorting outlet equipped with a stacker suitable for stacking said flat articles on edge in a stacking zone, said stacker further comprising at least one rotary actuator suitable for stacking said flat articles against a retaining element in the stacking zone, and at least one trailing edge flap provided between said switch flap and the rotary actuator and able to press the trailing portion of the flat article being stacked in said stacking zone, and upstream of the stacking zone between the trailing edge flap and the rotary actuator at least one blower nozzle suitable for blowing a jet of air towards the stacking zone cutting across the path of each flat article arriving in said stacking zone, wherein said sorting machine comprises a monitoring and control unit in which several operating programs are stored, each program being designed to control the blower nozzle, the trailing edge flap and the rotary actuator according to different operating parameters optimized for a specific type of article, said sorting machine further comprising detection means for determining the type of physical characteristics of each flat article conveying towards the stacker, and in response to that detection, the monitoring and control unit selects one operating program corresponding to the appropriate type of article to control at least one of the blower nozzle, trailing edge flap and retaining element.

2. A sorting machine according to claim 1, said trailing edge flap being mounted to move between a retracted position in which it is set back from said stacking zone so as not to interfere with said flat articles arriving in said stacking zone and an active position in which it is pivoted towards said stacking zone so as to press the trailing portion of the flat article being stacked towards said stacking zone, said trailing edge flap being controlled by said monitoring and control unit so as to go from its retracted position to its active position.

3. A sorting machine according to claim 1, wherein said trailing edge flap is configured to press said trailing edge toward said stacking zone.

* * * * *